US006367674B1

(12) United States Patent
Tabor

(10) Patent No.: US 6,367,674 B1
(45) Date of Patent: Apr. 9, 2002

(54) SPORTS BACKPACK

(75) Inventor: Richard E. Tabor, New York, NY (US)

(73) Assignee: Cotton Angora Trading Company, Cheshire, CT (US)

( * ) Notice: Subject to any disclaimer, the term of this patent is extended or adjusted under 35 U.S.C. 154(b) by 0 days.

(21) Appl. No.: 09/540,777

(22) Filed: Mar. 31, 2000

(51) Int. Cl.[7] ..... A45F 3/04

(52) U.S. Cl. ..... 224/650; 224/153; 224/651; 224/653

(58) Field of Search ..... 224/650, 152, 224/651, 652, 653, 642

(56) References Cited

U.S. PATENT DOCUMENTS

| | | | | |
|---|---|---|---|---|
| 4,883,207 A | | 11/1989 | McArthur | |
| 5,803,332 A | * | 9/1998 | Thompson | 224/651 |
| 5,881,708 A | * | 3/1999 | Kliot | 224/653 |
| D409,377 S | | 5/1999 | Kliot | |
| 5,927,581 A | | 7/1999 | Reddy et al. | |
| 6,237,825 B1 | * | 5/2001 | Pencoske | 224/652 |

* cited by examiner

*Primary Examiner*—Gregory M. Vidovich
*Assistant Examiner*—Maerena W. Brevard

(74) *Attorney, Agent, or Firm*—McCormick, Paulding & Huber LLP

(57) ABSTRACT

A sports backpack made from flexible sheet material has a main container and a pair of elongated upwardly extending shoe containers mounted at the rear of the main container in laterally spaced apart side-by-side relation to each other. The shoe containers cooperate with a back wall of the main container to define a rearwardly open carrying space for receiving in a carrying position an elongated portion of a sports playing device such as the barrel portion of a baseball bat or the handle and shaft portions of a tennis racket. An upwardly open pocket which is disposed between the footwear containers and defines the lower end of the carrying space receives, supports and retains a lower end of a sports playing device therein. An adjustable retaining strap assembly extends across the rear of the footwear containers in bridging relation to the carrying space for drawing the footwear containers toward each other and into gripping engagement with a portion of a sports playing device disposed in a carrying position within the carrying space and releasably retains the playing device on the backpack. An adjustable holding strap assembly mounted on the pack above the retaining strap assembly serves to releasably hold a portion of a playing device in engagement with one of the footwear containers. Shoulder straps permit the backpack to be worn in a conventional manner. A handle is provided for hand carrying.

20 Claims, 8 Drawing Sheets

SPORTS BACKPACK

FIELD OF INVENTION

This invention relates in general to article carriers and deals more particularly with an improved sports backpack for carrying bulky sports gear.

BACKGROUND OF THE INVENTION

There was a time when knapsacks and backpacks were generally associated with hiking and camping and where used almost exclusively in those activities. However, in recent years the trend toward more casual lifestyle has contributed to the acceptance and rise in popularity of the backpack as a convenient means for transporting articles of all kinds and special purpose backpacks have been developed for a wide range of usages.

Heretofore, such special purpose backpacks have been provided for carrying bulky sports gear. One such backpack shown in U.S. Pat. No. 5,927,581 to Reddy is particularly adapted to carry a large sports ball, such as a basketball and is convertible between a backpack and a shoulder bag. Another backpack for bulky sports gear and footwear is shown in the patent to Kliot, Des. 409,377. A shoulder carried sports pack shown in the patent to McArthur, 4,883,207, is particularly suited to carry equipment for recreational water sports such as scuba diving and provides pockets for carrying flippers. However, such backpacks as heretofore available are not generally suited to contain or otherwise carry an elongated sports playing device such as a baseball bat or a tennis racket having an elongated handle and shaft.

Accordingly, it is the general aim of the present invention to provide an improved, versatile sports backpack particularly adapted to carry sports apparel including such specialized footwear as may be required to play a sport and an elongated playing device such as a bat or a racket, for example. It is a further aim of the invention to provide an improved sports backpack to be worn on the back when hiking or cycling, but which may be conveniently hand carried, when necessary, as when traveling by public transportation. Yet another aim of the invention is to provide a backpack which may be folded to a convenient size for storage when not in use.

SUMMARY OF THE INVENTION

In accordance with the present invention, an improved sports backpack has a pack body formed from flexible sheet material and includes a main container having front and rear walls and defining a main carrying compartment. The pack body further includes a pair of elongated upwardly extending footwear containers located rearward of the main container and disposed in laterally spaced apart side-by-side relation to each other. The footwear containers cooperate with the rear wall to define a rearwardly open carrying space for receiving and containing in a carrying position an elongated portion of a sports playing device, such as the barrel portion of a baseball bat or the handle and shaft portions of a tennis racket. A releasable retaining means draws the shoe containers toward each other and into gripping engagement with an associated portion of the playing device to releasably secure the playing device to the backpack.

DETAILED DESCRIPTION OF PREFERRED EMBODIMENT

Figure 1:
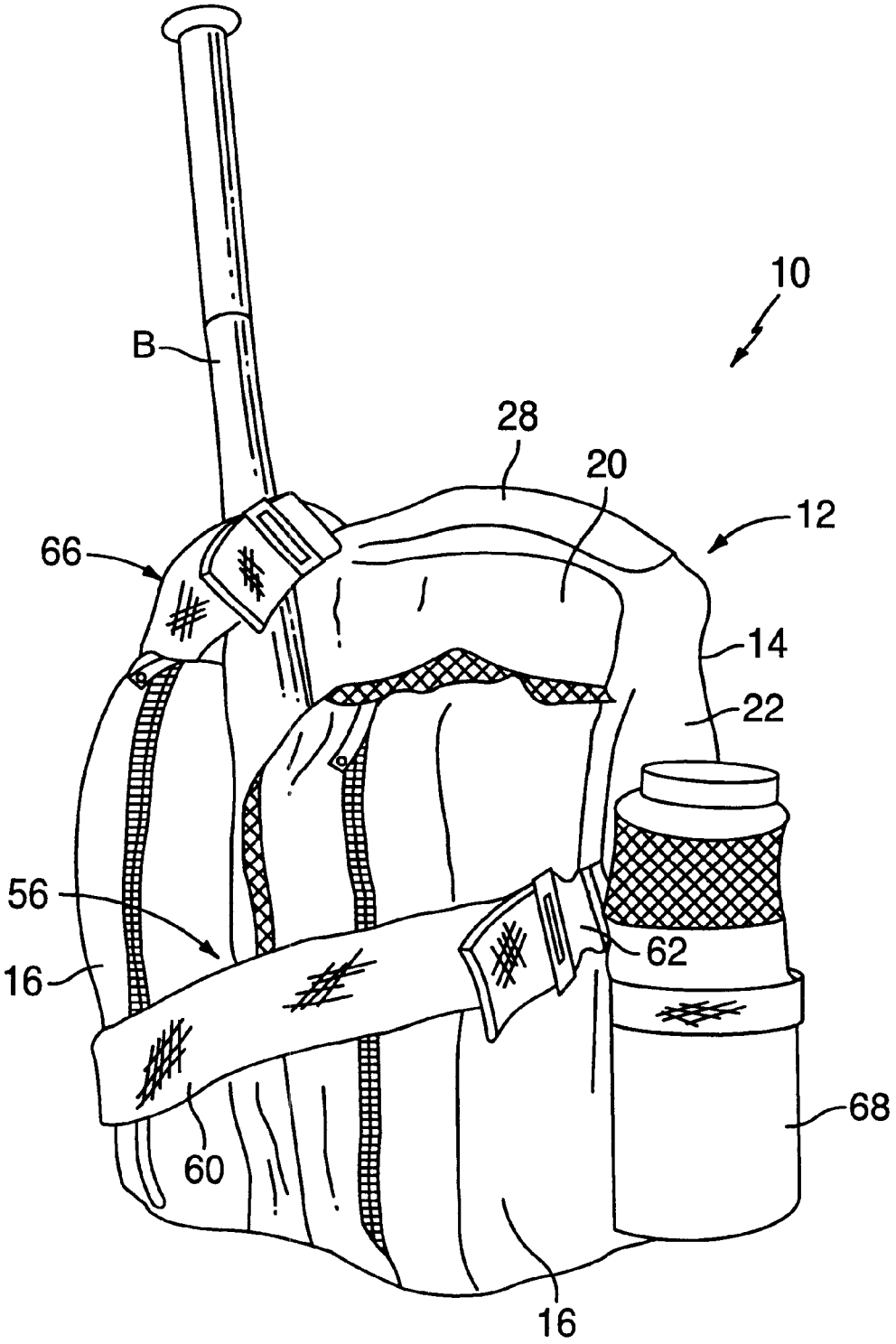
FIG. 1 is a rear perspective view of a sports backpack embodying the present invention shown with a baseball bat secured in a carrying position thereon.

Turn now to the drawings, a sports backpack embodying the present invention is indicated generally by the reference numeral 10. The backpack 10 essentially comprises a pack body made from suitable water repellent flexible sheet material and designated generally by the numeral 12. The pack body includes a main storage container 14, suitable for carrying sports apparel, a towel, and miscellaneous other items. A pair of footwear containers 16,16, each define a storage compartment for carrying a shoe or the like separated from the articles in the main storage compartment. The backpack 10 is further constructed and arranged to carry an elongated sports playing device, such as a baseball bat shown in FIG. 1 and indicated by the letter B. A playing device of another kind or any elongated article of suitable size and length may be carried on the pack 10, as, for example, a tennis racket having elongated handle and shaft portions, and in FIG. 2 the backpack 10 is shown with a racket, indicated by the letter R, supported in a carrying position thereon.

Further referring to the drawings and considering the backpack 10 in more detail and as it appear oriented in the drawings, the main storage container 14 has a front wall 18, a rear wall 20, and pair of opposing sidewalls 22 and 24, a bottom wall 26, and an arcuately upwardly arched top wall 28. Access to the storage compartment defined by the main storage container 14 is provided through an opening in the top wall 28. The opening extends across the entire width of the top wall between the sidewalls and is closed by a slide fastener or zipper 30. A closure flap 32 formed on the top wall overlies the zipper 30 when the main storage container 14 is secured in closed position by the zipper.

The front wall 18, normally rests on the back of a person wearing the pack, is padded for the comfort, and imparts a degree of rigidity to the pack. More specifically, the front wall 18 is formed by two layers of sheet material or fabric with padding material 32 sandwiched therebetween. The padding layer imparts rigidity to the front wall. The outer layers of the padded front wall are stitched together through the inner padding to prevent shifting of the padding. The stitching, best shown in FIG. 3 includes a main stitch indicated at 34 which extends from the top wall 28 to the bottom wall 26, bisecting the front wall 18, substantially as shown. The main stitch 34 defines a fold line along which the front wall may be forwardly folded onto itself to collapse the empty pack to a somewhat more convenient size for storage when not in use.

A relatively deep front pocket (not shown) is provided within the storage compartment defined by the main storage container 14 and is located adjacent the inner surface of the front wall 18. The front pocket which is partially defined by the front wall 18 may be used to carry a towel or the like separated from other articles in the main compartment. Another somewhat smaller rear pocket (not shown) which has a zipper closure is located in the main storage compartment adjacent the rear wall 20 and is suitable for carrying a wallet, keys, and other small personal articles.

Figure 3:
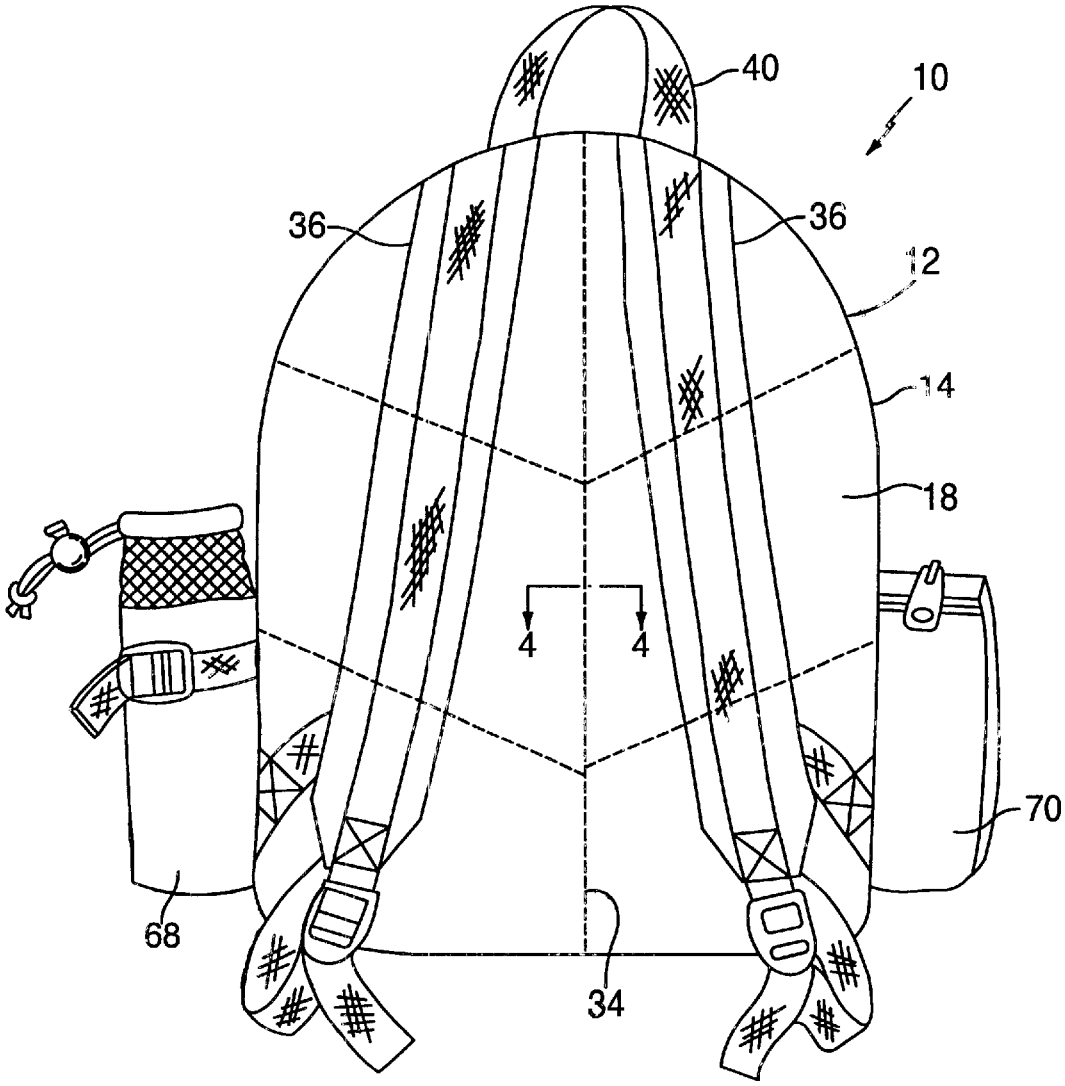
FIG. 3 is a front elevational view of the backpack of FIG. 1.
Figure 4:
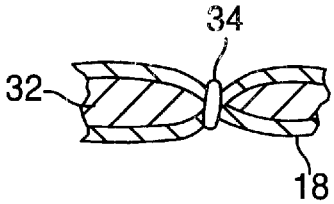
FIG. 4 is a fragmentary sectional view taken along the line 4—4 of FIG. 3.
Figure 5:
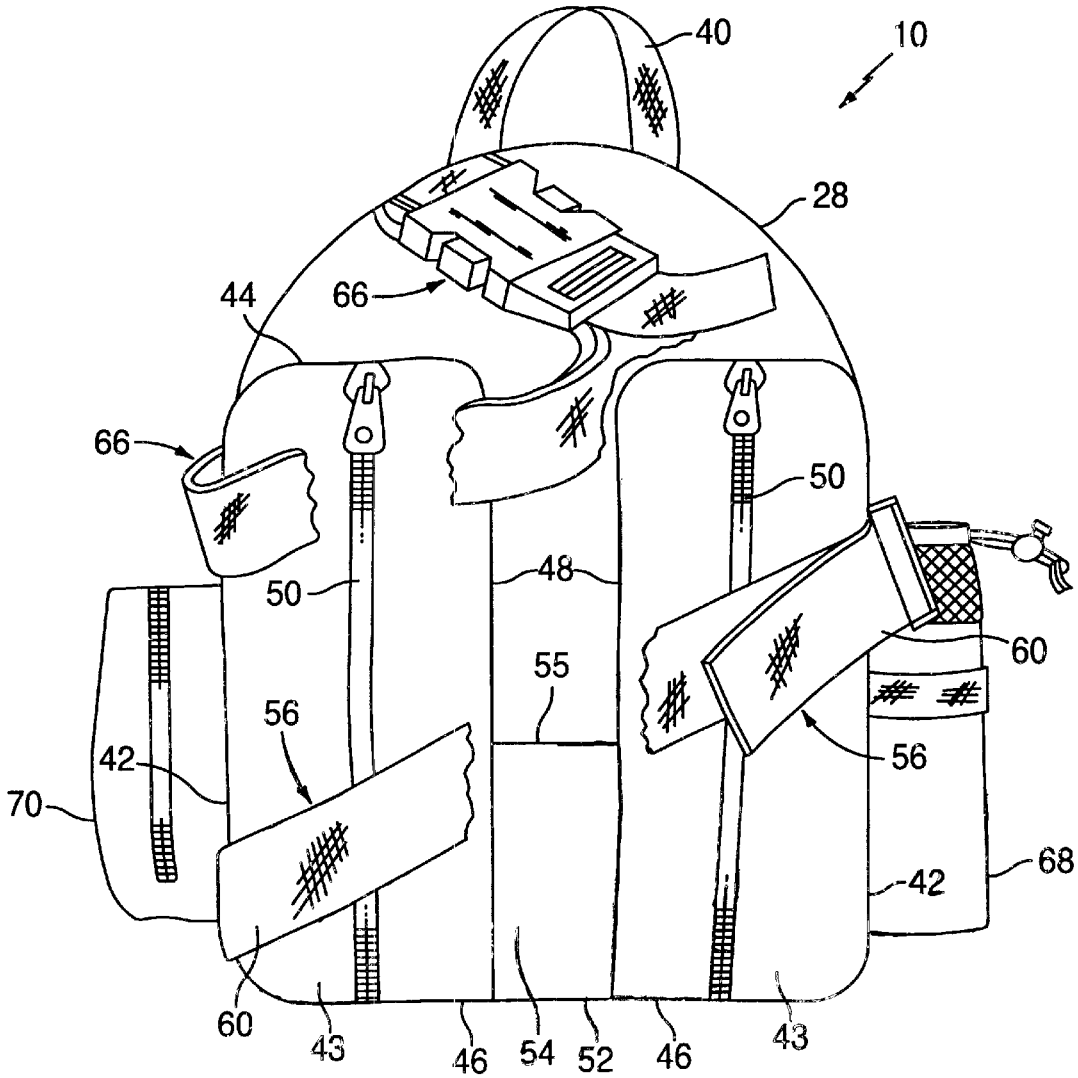
FIG. 5 is a rear elevational view of the backpack.
Figure 6:
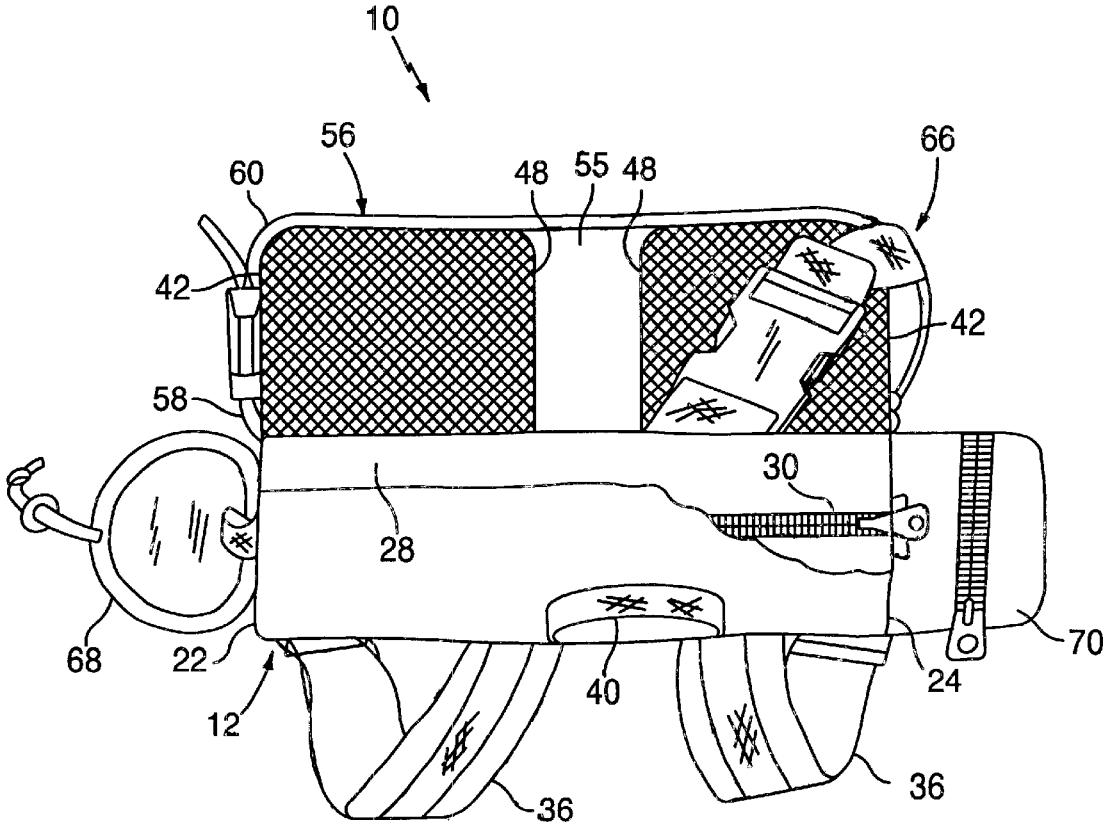
FIG. 6 is a top plan view of the backpack as it appears in FIG. 3.
Figure 7:
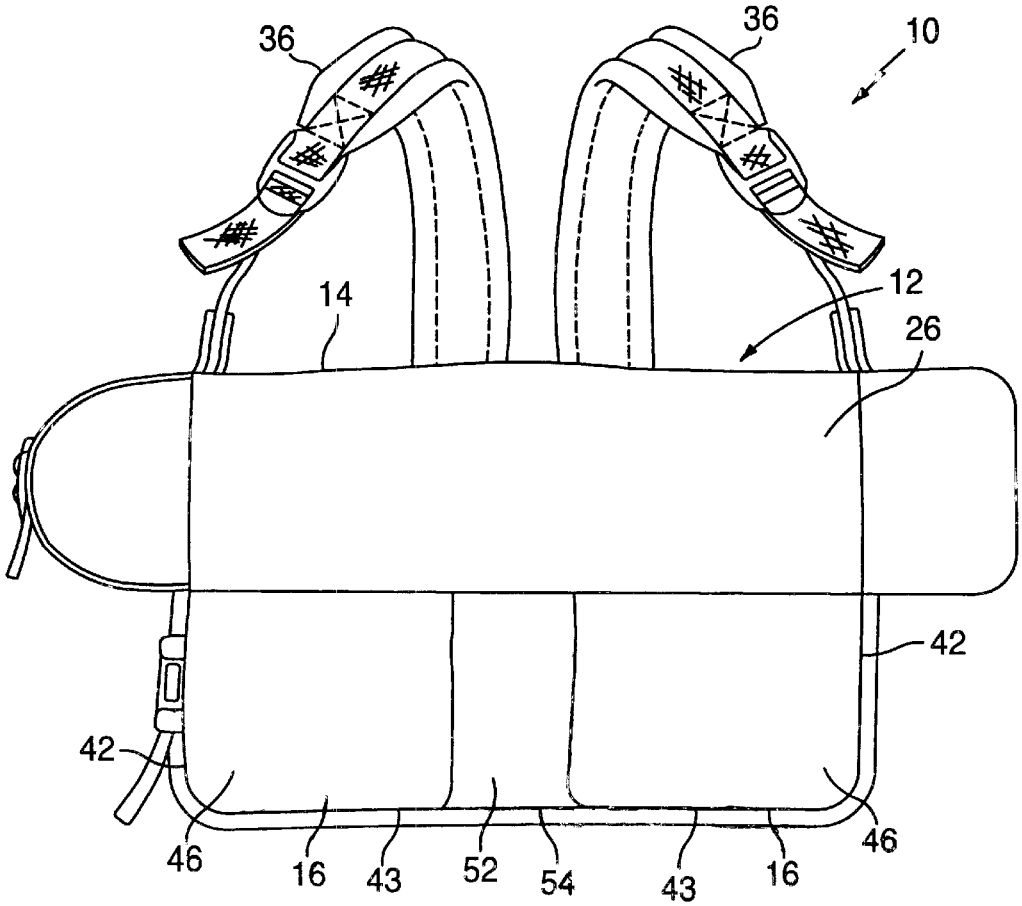
FIG. 7 is a bottom plan view of the backpack as it appears in FIG. 3.
Figure 8:
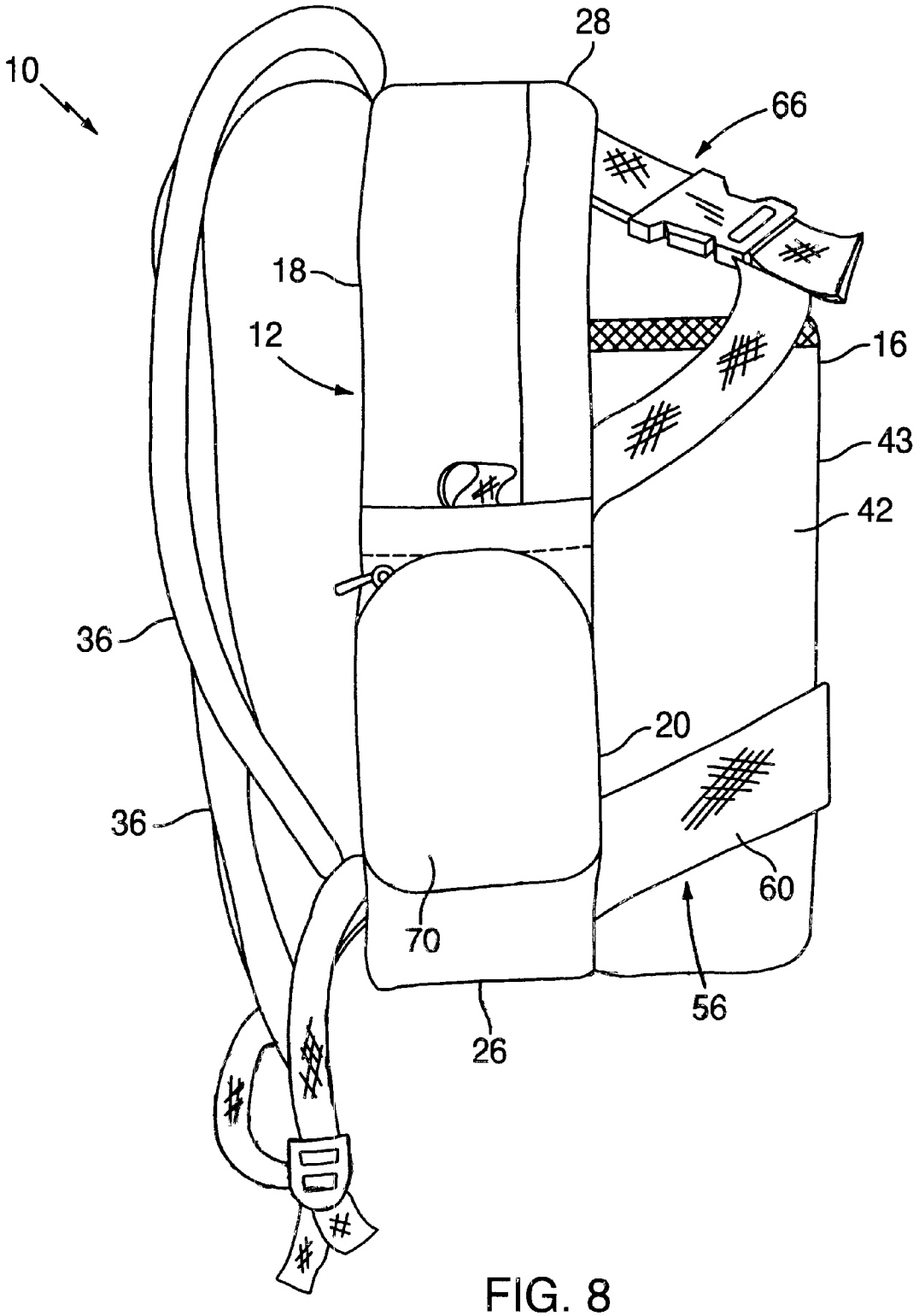
FIG. 8 is a right side elevational view of the backpack as it appears in FIG. 3.

A pair of padded shoulder straps 36,36 of adjustable length are disposed forwardly of the front wall 18 for use when the pack is worn as a backpack. The shoulder straps are preferably made from a web material and have upper ends secured in spaced apart relation to each other near the upper end of the pack and at junctions of the front and top walls. The lower ends of the adjustable shoulder straps 36,36 are respectively stitched to gussets attached to opposite sides of the pack body at junctions of the front and side walls of the main container 14. The shoulder straps 36,36 are inclined downwardly from the upper end of the pack and away from each other and are adapted to be disposed between opposite halves of the front wall 18 when the pack is folded to a collapsed position along the fold line defined by the main stitch 34. A carrying handle 40 preferably formed from flexible web material, is located centrally of the upper end of the pack body 12, the opposite ends of the handle being stitched to the pack body in laterally spaced apart relation to each other at junctions between the front and top walls, as best shown in FIGS. 3 and 6.

The footwear containers 16,16 comprise generally rectangular containers, define shoe receiving compartments, and are mounted in upwardly extending positions on the rear wall 20 and in laterally spaced apart side-by-side relation to each other, the front wall of each footwear compartment being defined by an associated portion of the main container rear wall 20. Each footwear container 16 has an outer side wall 42 which forms a rearward extension of an associated one of the side walls 22 and 24 of the main storage container. Each footwear container also has a rear wall 43, a top wall 44, a bottom wall 46 and an inner side wall 48. At least a portion of one wall of each footwear container 16 provided with ventilation openings compartment. In the presently preferred embodiment 10, the top and inner side wall of each container 16 are formed from a flexible net material which defines the ventilation openings. Access to the interior of each shoe container 16 is provided by a vertically disposed central opening in the rear wall 43 which extends from the top wall 44 to the bottom wall 46. A zipper 50 provides a closure for the latter opening.

Figure 2:
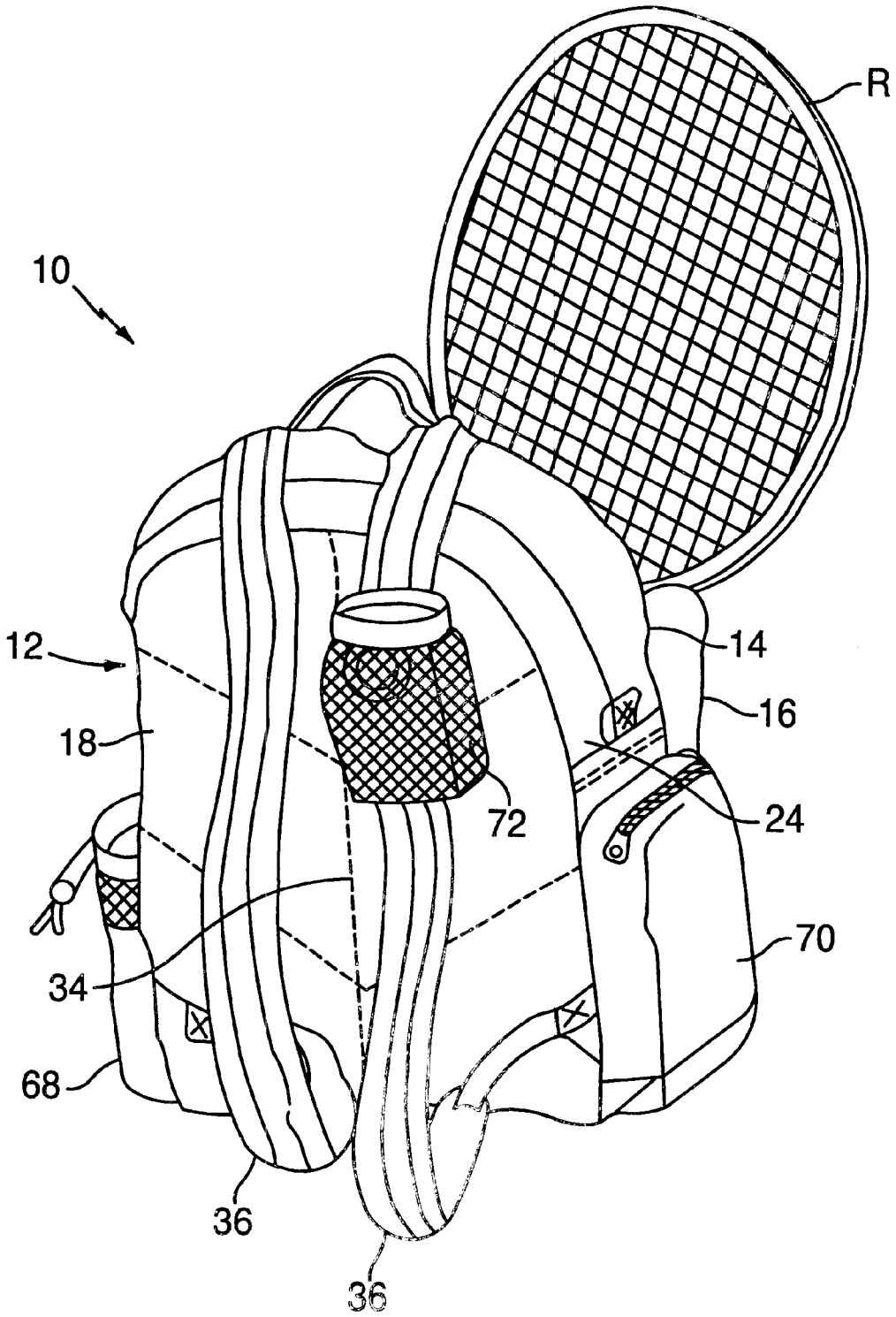
FIG. 2 is front perspective view of the backpack of FIG. 1, but shown with a tennis racket secured thereto in a carrying position.

The opposing inner side walls 48,48 of the footwear containers are spaced apart a sufficient distance to define a carrying space therebetween for receiving and containing an elongated portion of a sports playing device as, for example, the barrel of a baseball bat, such as the bat B shown in FIG. 1, or the handle and shaft portions of a tennis racket, such as the racket R shown in FIG. 2.

A horizontally disposed supporting wall 52, which comprises a part of the pack body 12, extends across the space between the lower ends of the footwear containers 16,16. Preferably, and as shown, the supporting wall 52 and the footwear container bottom walls 46,46 are disposed generally within a common plane. The supporting wall 52 serves to support a lower end of a playing device or other article disposed in a carrying position in the carrying space between the footwear containers. The pack body further includes a generally vertically disposed and rearwardly facing retaining wall 54 which extends across the carrying space between the footwear container inner side walls 48,48 near the lower ends of the containers. The retaining wall 54 serves to retain in a carrying position a lower end portion of a playing device or other article supported in carrying position in the carrying space between the footwear containers 16,16. In accordance with presently preferred construction, the retaining wall 54 lies within the plane of the footwear container rear walls 43,43, is joined to the rear edge of the supporting wall 52, and cooperates with the supporting wall and portions of the rear wall 20 and the inner side walls 48,48 to form an upwardly open pocket 55 at the lower end of the pack body 12 bridging the carrying space between the footwear containers 16,16 for receiving, supporting and retaining the lower end of a playing device or other article in carrying position within the carrying space between the footwear containers.

Figure 9:
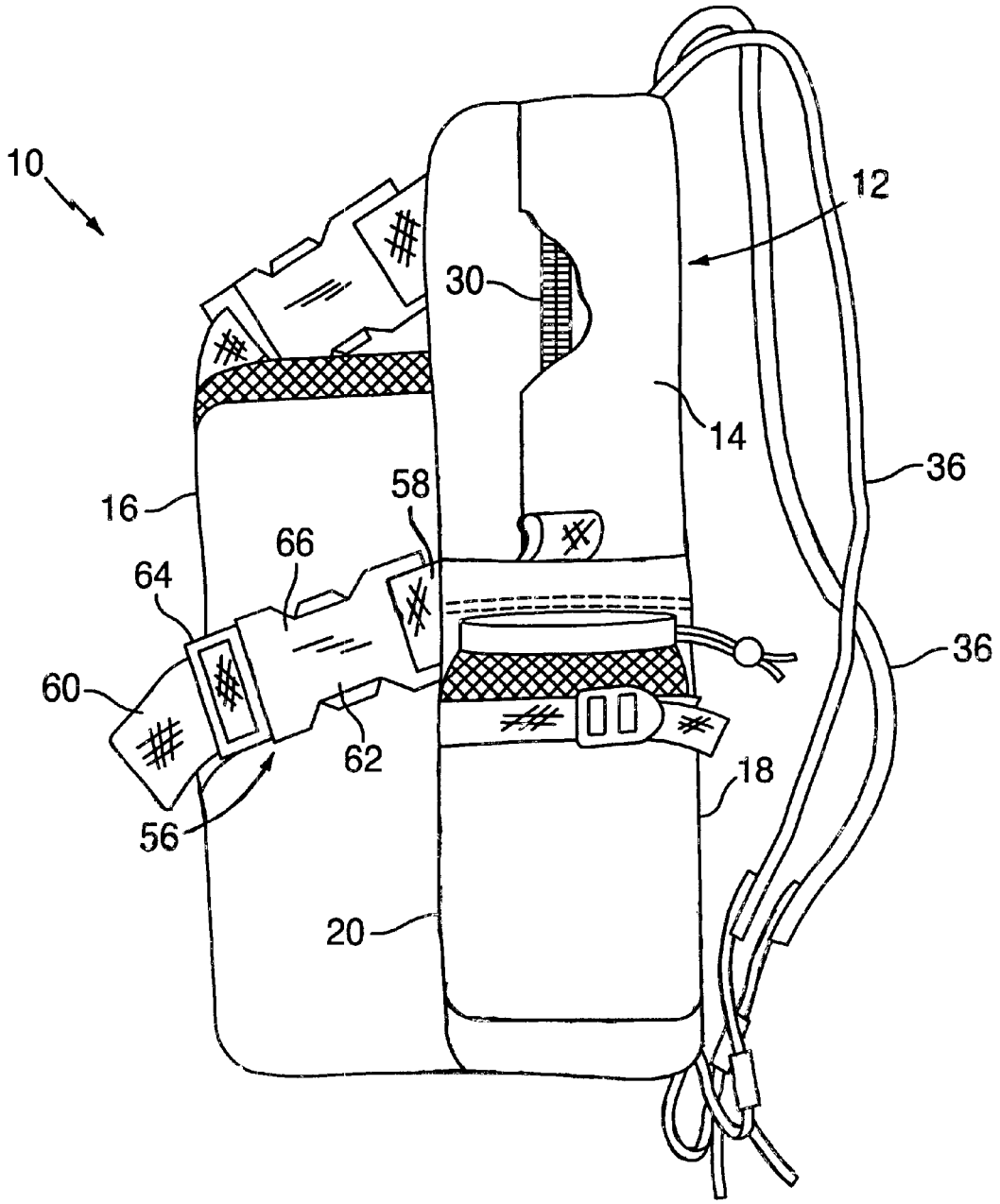
FIG. 9 is a left side elevational view of the backpack as it appears in FIG. 3.

An article disposed in carrying position within the pocket 55 extends upwardly between the opposing inner side walls 48,48 and is further retained on the backpack 10 by an adjustable retaining strap assembly indicated generally at 56. The retaining strap assembly 56 essentially comprises a pair of separable retaining straps 58 and 60 releasably connected together by a quick connect and release buckle 62 of a well-known type. One of the retaining straps is attached to the pack body at one side of the body and at a junction between the rear wall 20 and an associated outer side wall 42 and near the lower end of the body. The other retaining strap 60 is attached to the opposite side of the pack body and at a junction between the rear wall 20 and the other outer side wall 42, but at a somewhat higher elevation relative to the lower end of the pack body. Thus, the retaining strap assembly 56 extends across the rear walls 43,43 of both footwear containers 16,16 and is upwardly inclined from one side of the pack body toward the opposite side of the body, substantially as shown in the drawings. As shown in FIG. 9, the buckle 62 has two separable parts 64 and 66 releasably connected together by resilient latches. The two buckle parts may be separated from each other by pinching a central portion of the buckle to release the latches. Shortening the effective length of the adjustable retaining strap 56 by pulling on the free end of the strap 60 causes the retaining strap assembly to draw the footwear containers 16,16 toward each other thereby bringing the inner side walls 48,48 into gripping engagement with a playing member, such as the bat B, or other elongated article supported in carrying position therebetween.

An additional holding strap assembly, indicated generally at 66, is provided to further secure a playing member or other article in carrying position on the backpack 10. Like the retaining strap assembly 56, previously described, the holding strap assembly 66 includes a pair of holding straps and a quick connect and disconnect buckle. One end of the holding strap assembly 66 is attached to one side of the pack body near the upper end of the footwear container 16 at that side of the body and at the junction formed by the main container rear wall 20 and outer side wall 42. The other end of the holding strap assembly 66 is attached to an upper portion of the pack body 12 at a junction between the rear wall 20 and the top wall 28. The holding strap assembly 66 is upwardly inclined in the manner of the retaining strap assembly 56 and in the general direction of incline of the retaining strap assembly. The holding strap assembly 66 is adapted to engage a portion of the playing member or other article being carried at a location above the top walls of the footwear containers 16,16 and further serves to hold the playing member or other article in carrying position within the carrying space between the footwear containers. The quick connect and release buckles on the retaining and holding strap assemblies permit an article to be quickly released from its carrying position without altering the adjustment of the retaining and holding straps. The article may then be quickly returned to its carrying position on the pack without further strap adjustment.

An insulated water bottle container 68 is mounted on one side of the pack body 12. A pouch 70 with a zipper closure is also located externally of the pack body and at the opposite side of the body and provides a container for small articles which may be readily accessed without opening the main storage container 14. A pouch for a portable radio or cellular telephone, shown in FIG. 2 and indicated at 72, may also be provided and conveniently attached to one of the shoulder straps by a VELCRO fastener (not shown).

Although the pack is normally worn on the back supported by the shoulder straps 36,36, it can also be hand carried by the handle 40 as, for example, when traveling on public transportation where the pack cannot be conveniently be worn.

I claim:

1. A sports backpack comprising;

a pack body made from flexible sheet material and including a main container having a front wall and a rear wall, said pack body including a pair of elongated upwardly extending footwear containers mounted at the rear of said main container in laterally spaced apart side-by-side relation to each other and cooperating with said rear wall to define a carrying space rearward of said rear wall and between said footwear containers for receiving and containing an elongated portion of a sports playing device in an upwardly extending carrying position therein, supporting means for supporting a lower end of a sports playing device disposed in a carrying position within said carrying space including a generally horizontally disposed and upwardly facing supporting wall on said pack body extending between said footwear containers, and retaining means for releasably securing to said backpack an elongated portion of a sports playing device disposed in a carrying position within said carrying space.

2. A sports backpack as set forth in claim 1 wherein said footwear containers have opposing inner side walls and said retaining means comprises means for drawing said footwear containers laterally inwardly and toward each other to bring said opposing inner sidewalls of said footwear containers into gripping engagement with an elongated portion of a sports playing device disposed in a carrying position within said carrying space and includes an elongated retaining strap assembly of adjustable length having opposite end portions connected to said pack body at opposite sides of said pack body and extends across said footwear containers and said carrying space at the rear of said footwear containers.

3. A sports backpack assembly as set forth in claim 2 wherein said retaining strap assembly is upwardly inclined from one side of said pack body to the other side of said pack body.

4. A sports backpack assembly as set forth in claim 2 wherein said retaining strap assembly includes a pair of separable retaining straps and a quick connect and release buckle releasably securing said retaining straps in connected relation to each other.

5. A sports backpack as set forth in claim 1 wherein said backpack includes holding means for releasably securing to one of said footwear containers an elongated portion of a sports playing device disposed in a carrying position within said carrying space.

6. A sports backpack as set forth in claim 5 wherein said holding means comprises a holding strap assembly having one end connected to said pack body at one side of said carrying space and another end connected to an upper portion of said pack body.

7. A sports backpack as set forth in claim 6 wherein said holding strap assembly comprises a pair of separable holding straps and a quick connect end release buckle releasably retaining the straps in connected relation to each other.

8. A sports backpack as set forth in claim 1 wherein said backpack includes a generally vertically disposed retaining wall extending between said footwear containers and across said carrying space.

9. A sports backpack as set forth in claim 8 wherein said retaining wall is connected to said supporting wall and cooperates with said supporting wall and said back wall to define an upwardly open pocket.

10. A sports backpack as set forth in claim 1 wherein said footwear containers have bottom walls and said bottom walls and said supporting wall lie generally within a common plane.

11. A sports backpack as set forth in claim 1 wherein each of said footwear containers has ventilation openings therethrough.

12. A sports backpack as set forth in claim 11 wherein a portion of each footwear container is formed by a flexible net material and said ventilation openings are defined by said net material.

13. A sports backpack as set forth in claim 1 wherein said front wall comprises a lamination of flexible sheet material and padding material.

14. A sports backpack as set forth in claim 1 wherein said front wall comprises a laminated wall formed by a layer of padding material sandwiched between layers of flexible sheet material and imparting rigidity to said front wall.

15. A sports backpack as set forth in claim 14 including a vertical line of stitching through said laminated front wall and extending between the upper and lower ends of said front wall bisecting said front wall.

16. A sports backpack as set forth in claim 15 wherein said line of stitching defines a fold line along which said backpack may be folded to a smaller size for storage.

17. A sports backpack as set forth in claim 1 wherein said footwear containers comprise generally rectangular containers defining discrete shoe receiving compartments and a front wall of each of said footwear containers is defined by an associated portion of said rear wall of said main container.

18. A sports backpack comprising:

a pack body made from flexible sheet material and including a main container having a front wall and a rear wall, said pack body including a pair of elongated upwardly extending footwear containers mounted at the rear of said main container in laterally spaced apart side-by-side relation to each other and cooperating with said rear wall to define a rearwardly open carrying space therebetween for receiving and containing an elongated portion of a sports playing device in an upwardly extending carrying position therein, an upwardly open pocket formed by walls of said pack body extending between said footwear containers and defining the lower end of said carrying space, and retaining means for drawing said footwear containers laterally inwardly and toward each other to grippingly engage an elongated portion of a sports playing device disposed in said carrying position to releasably secure the sports playing device to said backpack.

19. A sports backpack comprising;

a pack body made from flexible sheet material and including a main container having a front wall and a rear wall, said pack body including a pair of elongated upwardly extending footwear containers mounted at the rear of said main container in laterally spaced apart side-by-side relation to each other and cooperating with said rear wall to define a carrying space therebetween for receiving and containing an elongated portion of a sports playing device in an upwardly extending carrying position therein, and an upwardly facing wall extending between said footwear containers and defining a lower end of said carrying space, and retaining means for drawing said footwear containers laterally inwardly and toward each other to grippingly engage an elongated portion of a sports playing device disposed in said carrying position and releasably secure the sports playing device to said backpack and including an elongated retaining strap assembly of adjustable length having opposite end portions connected to said pack body at opposite sides of said pack body and extending across the rear of said footwear containers and said carrying space.

20. A sports backpack comprising;

a pack body made from flexible sheet material and including a main container having a rear wall and a laminated front wall formed by a layer of padding material sandwiched between layers of flexible sheet material and imparting rigidity to said main container, said pack body including a pair of elongated upwardly extending footwear containers mounted at the rear of said main container in laterally spaced apart side-by-side relation to each other and cooperating with said rear wall to define a carrying space rearward of said rear wall and between said footwear containers for receiving and containing an elongated portion of a sports playing device in an upwardly extending carrying position therein, retaining means for releasably securing to said backpack an elongated portion of a sports playing device disposed in a carrying position within said carrying space, and a vertical line of stitching through said laminated front wall and extending between the upper and lower ends of said front wall bisecting said front wall, said line of stitching defining a fold line along which said backpack may be folded to a smaller size for storage.

* * * * *